US006934997B2

(12) United States Patent
Lau

(10) Patent No.: US 6,934,997 B2
(45) Date of Patent: Aug. 30, 2005

(54) RETRACTABLE LUGGAGE HANDLE WITH GRADUAL EXTENDING SPEED

(75) Inventor: Boon Hwa Lau, Hsin Chuang (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 51 days.

(21) Appl. No.: 10/617,380

(22) Filed: Jul. 11, 2003

(65) Prior Publication Data

US 2004/0177475 A1 Sep. 16, 2004

(30) Foreign Application Priority Data

Mar. 12, 2003 (CN) ..... 03240534 U

(51) Int. Cl.[7] ..... E05B 7/00
(52) U.S. Cl. ..... 16/114.1; 190/115
(58) Field of Search ..... 190/18 A, 190, 190/115; 16/114.1, 113.1, 115, 405, 429; 280/47.29, 655, 655.1

(56) References Cited

U.S. PATENT DOCUMENTS 5,367,743 A * 11/1994 Chang ..... 16/113.1
5,522,615 A * 6/1996 Kazmark et al. ..... 280/655
5,692,266 A 12/1997 Tsai ..... 16/115
5,803,214 A * 9/1998 Wang ..... 190/115
5,806,143 A * 9/1998 Tsai ..... 16/405
5,836,052 A * 11/1998 Chou ..... 16/405
5,884,362 A * 3/1999 Tsai ..... 16/113.1
6,128,806 A * 10/2000 Shou-Mao ..... 16/113.1
6,141,828 A * 11/2000 Kuo ..... 16/113.1
6,161,253 A * 12/2000 Tu ..... 16/113.1
6,301,746 B1 * 10/2001 Myers et al. ..... 16/113.1
6,332,241 B1 * 12/2001 Kuo ..... 16/113.1
6,357,080 B1 * 3/2002 Tsai ..... 16/113.1
6,378,674 B1 * 4/2002 Lee ..... 190/115
6,470,529 B1 * 10/2002 Chang ..... 16/113.1
6,484,362 B1 * 11/2002 Kuo ..... 16/113.1
6,609,271 B2 * 8/2003 Kuo ..... 16/113.1
6,827,186 B1 * 12/2004 Hsie ..... 190/115
6,868,583 B2 * 3/2005 Kuo ..... 16/405

FOREIGN PATENT DOCUMENTS

CN 380389 1/2000

* cited by examiner

*Primary Examiner*—Robert J. Sandy
*Assistant Examiner*—Andre L. Jackson
(74) *Attorney, Agent, or Firm*—Troxell Law Office, PLLC

(57) ABSTRACT

A retractable handle assembly for luggage in a pulling operation, press a push button to cause a spring in a plunger of buffer device to gradually and damply extending upward immediately. As a result, both a piston rod and thus the buffer device move upward gradually and damply. Also, a sliding tube coupled to the locking mechanism moves upward gradually and damply. As an end, the handle assembly is capable of gradually and damply extending from a top of the luggage a predetermined distance. At this position, a user can easily pull the handle assembly up to its maximum.

10 Claims, 4 Drawing Sheets

RETRACTABLE LUGGAGE HANDLE WITH GRADUAL EXTENDING SPEED

BACKGROUND OF THE INVENTION

1. Field of the Invention

The present invention relates to a retractable handle of luggage and more particularly to such a retractable handle capable of gradually and damply extending from a top of luggage when a push button is pressed.

2. Description of Related Art

Wheeled luggage cases have developed rapidly over recent decades as more people travel either for business or for leisure. Early luggage handle assemblies are exposed, thus detracting from its external appearance. In recent years, most handle assemblies are concealed in the luggage with only a handle grip exposed. This can preserve the luggage's appearance. For facilitating user to pull the handle grip, a recessed bezel is typically provided on top of the luggage. It inevitably much detracts from its external appearance. For solving this problem, a number of designs about automatically bouncing a handle out of luggage have been proposed. For example, U.S. Pat. No. 5,692,266, entitled "Concealable And Expandable Handle' and Taiwanese Patent Published No. 380,389 entitled "Fixing Assembly For Luggage Handle Spring" are two of them. The former disclosed a spring for bouncing out the handle being formed in a bottom of support tube, while the latter disclosed the spring for bouncing out the handle being formed in a lower portion of sliding tube. In operation, a user can press a push button on the handle grip to bounce out the handle. In one aspect it is convenient. However, the sudden bouncing of the handle grip having a bounce distance from about 20 cm to about 30 cm may cause danger. For example, the head and/or the eyes of a user may be damaged by the suddenly bounced handle grip when the head of the user is close to the handle grip in pressing the push button and sufficient care is not taken. This is not a safe design and unsightly due to larger bounce distance from about 20 cm to about 30 cm. Moreover, a length of the handle may be shortened if the spring is provided either in the bottom of support tube or in the lower portion of sliding tube. Thus, the need for improvement still exists.

SUMMARY OF THE INVENTION

It is an object of the present invention to provide a retractable luggage handle capable of gradually and damply extending from a top of luggage when a push button is pressed.

It is another object of the present invention to provide a retractable luggage handle in which a buffer device is disposed within a sliding tube. Hence, a length of the handle of the present invention is the same as that of a handle without the provision of a buffer device.

It is a further object of the present invention to provide a retractable luggage handle capable of gradually and damply extending from the top of luggage a predetermined distance. Hence, the handle of the present invention is much safer as compared with the well known bouncing out handle.

The above and other objects, features and advantages of the present invention will become apparent from the following detailed description taken with the accompanying drawings.

DETAILED DESCRIPTION OF THE PREFERRED EMBODIMENTS

Figure 1:
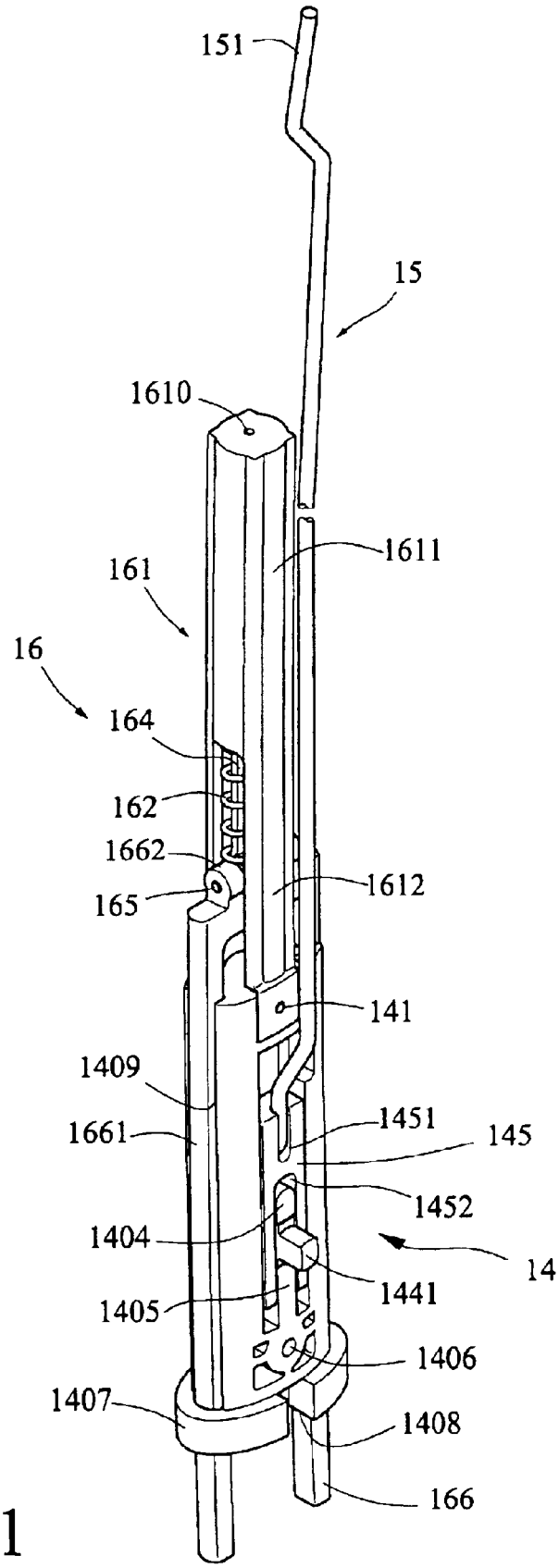
FIG. 1 is a perspective view of a preferred embodiment of retractable luggage handle according to the invention.
Figure 2:
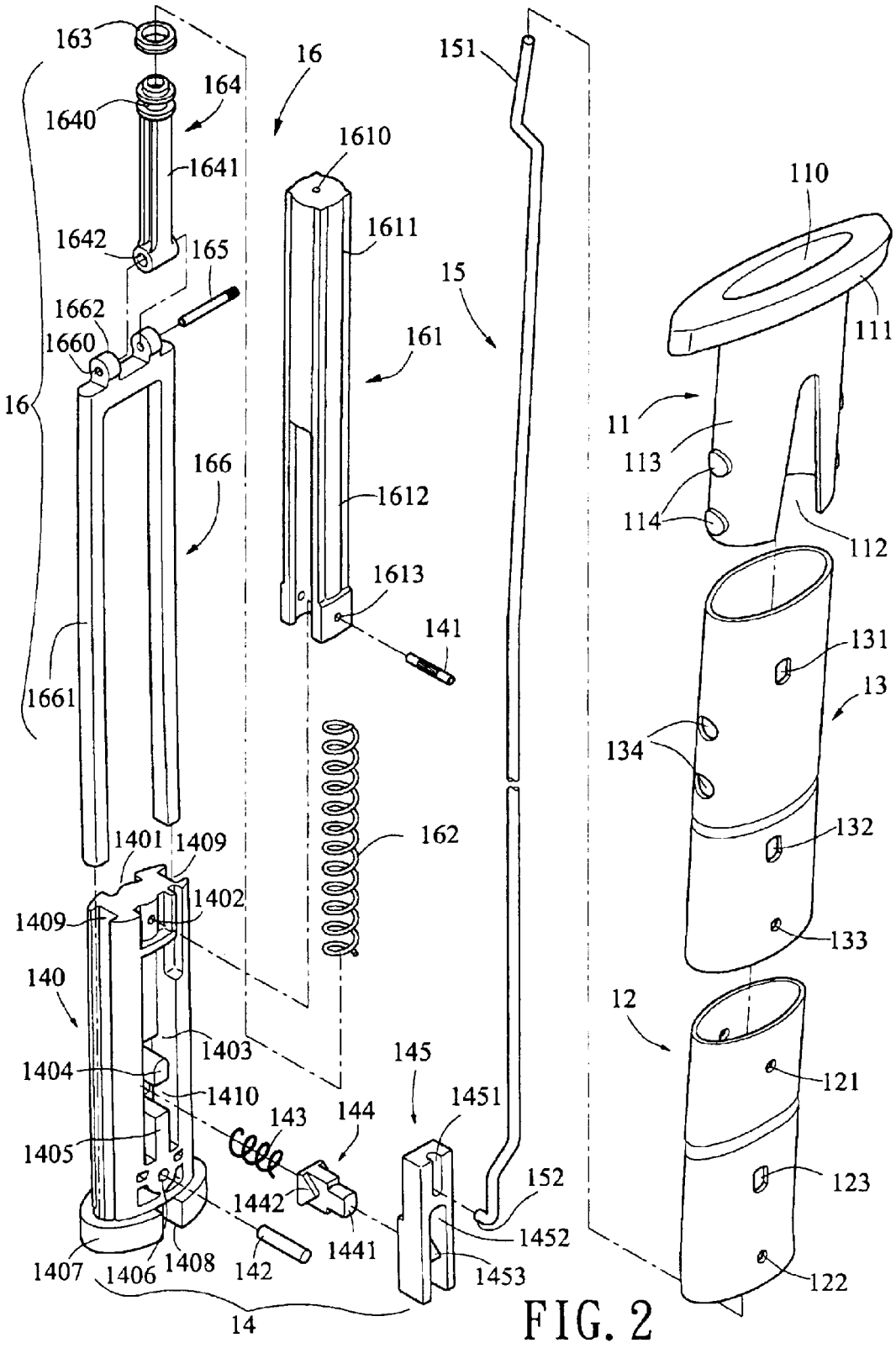
FIG. 2 is an exploded perspective view of the handle and other associated components such as sleeve, sliding tube, and support tube.
Figure 3:
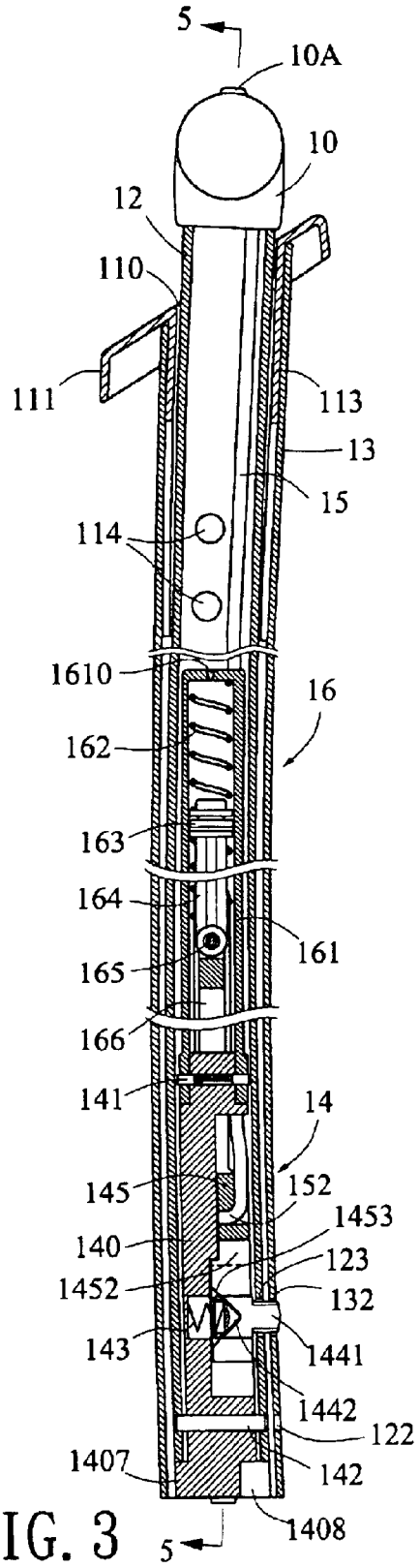
FIG. 3 is a cross-sectional view of the handle in a retracted position.

Referring to FIGS. 1 to 6, there is shown a retractable handle assembly mounted in a luggage case in accordance with the invention. In either side and a top of the luggage case, the handle comprises a sleeve 11 including a channel 110, a top annular flange 111, an opening 112 on an outer surface 113, and two opposite pairs of projections 114 on the outer surface 113; a handle grip 10 having a push button 10A; a sliding tube 12 inserted into the channel 110 thereunder and including two upper holes 121 so that a fastener can be inserted through the upper holes 121 to secure to the luggage case, two intermediate locking apertures 123, and two opposite lower holes 122; a support tube 13 fixed at a bottom of the luggage case, the sliding tube 12 being slidably disposed in the support tube 13, the support tube 13 including an upper locking aperture 131, an intermediate locking aperture 132, a lower hole 133, and two opposite pairs of indents 134; a locking device 14 in a lower portion of the sliding tube 12; a connecting rod 15 interconnected the push button 10A and the locking device 14 as detailed later; and a buffer device 16 within a lower portion of the sliding tube 12.

The locking device 14 comprises an elongate upright locking mechanism 140, a first spring 143, a locking block 144, and a sliding block 145. The locking mechanism 140 comprises an upper tunnel 1402 adjacent two upper recesses 1401, a longitudinal groove 1403 at one side, a protrusion 1404 in a central portion of the groove 1403, a lower ridge 1405, a lower tunnel 1406, two opposite longitudinal troughs 1409, a bottom annular flange 1407, and a recessed portion 1410 between the protrusion 1404 and the ridge 1405. The recessed portion 1410 is provided to receive the locking block 144 and the first spring 143. The locking block 144 comprises a V-shaped projection 1442 at either side and a locking pin 1441 between the V-shaped projections 1442. The sliding block 145 comprises an upper longitudinal hole 1451 for anchoring a lower hook end 152 of the connecting rod 15, a lower longitudinal channel 1452 slidable in the groove 1403, and a V-shaped indent 1453 at either side of the lower longitudinal channel 1452 being engageable with the V-shaped projection 1442 for locking the handle assembly.

The buffer device 16 comprises an upper plunger 161, a second spring 162 anchored in the plunger 161, a piston rod 164 inserted in the second spring 162, a sealing ring 163 anchored on top of the piston rod 164, a lower n-shaped bifurcation 166 urged against a bottom of the second spring 162, and a first pin 165 hingedly coupled a top of the n-shaped bifurcation 166 and a bottom of the piston rod 164 together. In detail, the plunger 161 comprises an upper body 1611 and a vent hole 1610 on a top of the upper body 1611. Note that the number of the vent hole 1610 may be increased or eliminated depending on applications. The plunger 161 further comprises a hole 1613 at a lower portion of either lower arm 1612. The piston rod 164 comprises an upper neck 1640, an intermediate body 1641, and a bottom tunnel 1642. The n-shaped bifurcation 166 comprises two legs 1661 and two spaced top cylindrical members 1662 each having a tunnel 1660.

In assembly, insert first pin 165 into the tunnels 1660, 1642 to pivotably secure the piston rod 164 to the bifurcation 166. Next, put the sealing ring 163 on the neck 1640. Then put second spring 162 on top of the piston rod 164 prior to inserting an upper portion of the buffer device 16 into the housing defined by the arms 1612 and sliding the legs 1661 through the longitudinal troughs 1409 and the annular flange 1407 until bottoms of the arms 1612 are anchored in the recesses 1401. Insert a second pin 141 through the holes 1613 and the tunnel 1402 to fasten the buffer device 16 and the locking mechanism 140 together. Fasten the lower hook end 152 of the connecting rod 15 in the longitudinal hole 1451 of the sliding block 145 and fasten an upper end 151 thereof and the push button 10A together. This forms the handle shown in FIG. 1. Next, insert a third pin 142 through the lower holes 122 of the sliding tube 12 and the tunnel 1406 to fasten the sliding tube 12 and the locking mechanism 140 together. Put the support tube 13 onto the sliding tube 12 and secure the support tube 13 to the luggage case. Finally, put the sleeve 11 on the support tube 13 and snap the pairs of projections 114 into the holes 134 for fastening the sleeve 11 and the support tube 13 together. This forms one side of the handle assembly of the invention.

Referring to FIGS. 3 and 5 again, there is shown a non-operative position of the handle assembly. As shown, the handle grip 10 is located at the top of the sleeve 11. The sliding tube 12 is received in the support tube 13. The bottoms of the sliding tube 12 and the support tube 13 are located at the bottom of the luggage case. The locking pin 1441 is snapped in the locking apertures 123, 132 in a locked state. The buffer device 16 is on top of the locking mechanism 140.

Figure 4:
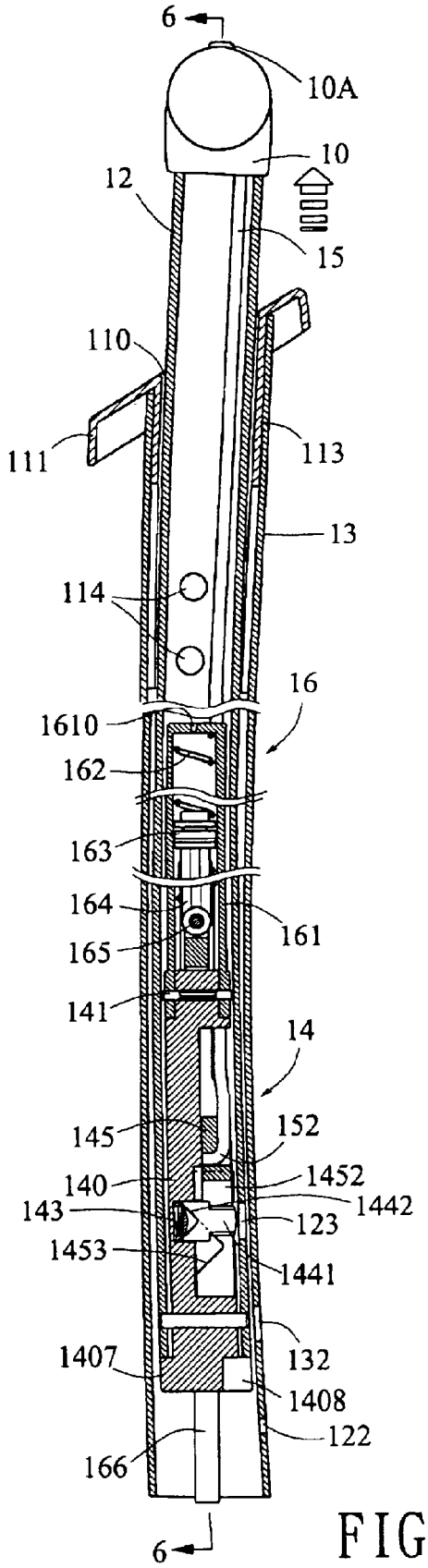
FIG. 4 is a view similar to FIG. 3 where the handle is in an extended position after pressing a push button.
Figure 5:
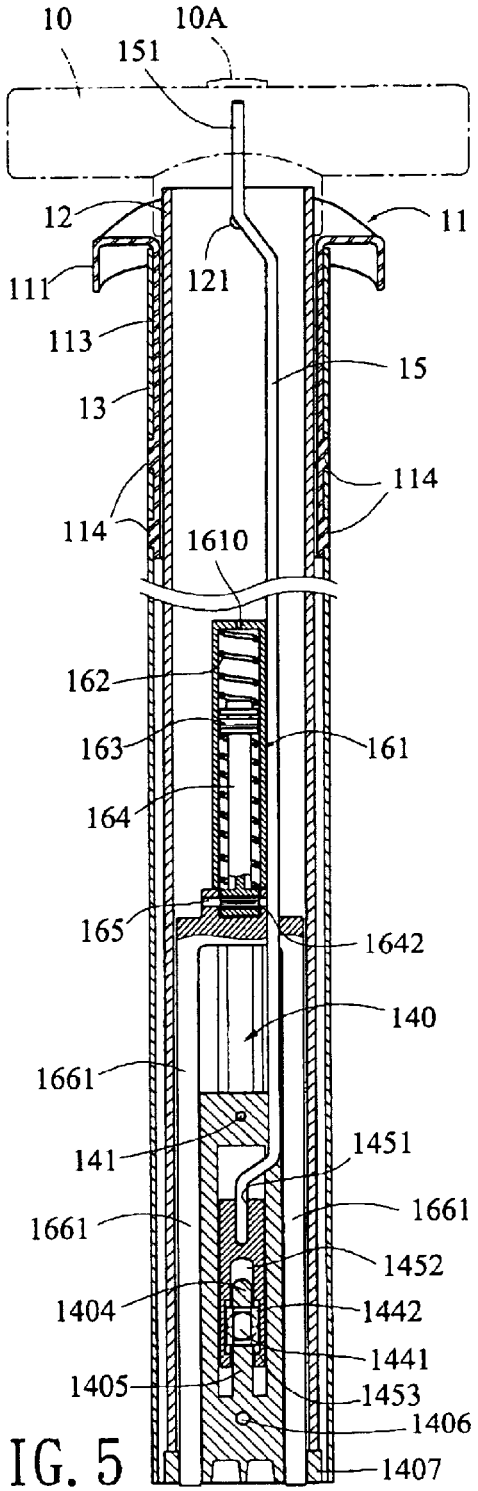
FIG. 5 is a cross-sectional view of the handle taken along line 5—5 in FIG. 3.
Figure 6:
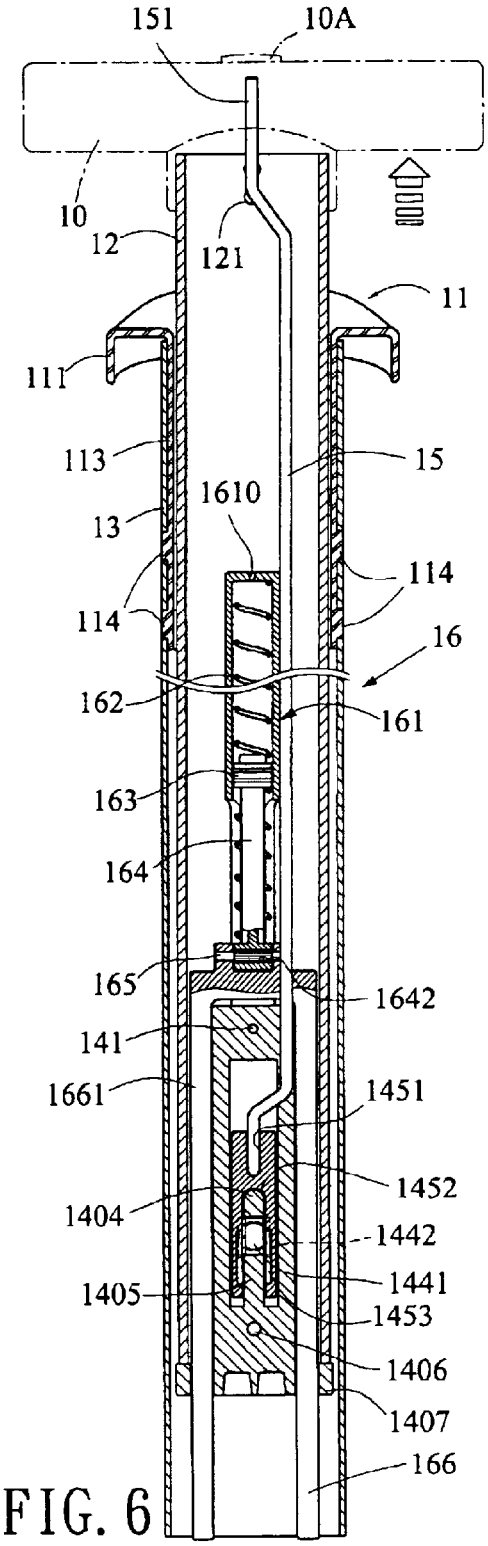
FIG. 6 is a cross-sectional view of the handle taken along line 6—6 in FIG. 4.

Referring to FIGS. 4 and 6 again, an operative position of the handle assembly will now be described in detail. First, press the push button 10A to cause the upper end 151 of the connecting rod 15 to the lower hook end 152. As a result, the sliding block 145 is lowered due to a downward movement of the hooked end 152 of the connecting rod 15. The V-shaped projections 1442 and thus the locking block 144 move inward by the downward movement of the V-shaped indents 1453 to compress the first spring 143. As such, the locking pin 1441 clears from the locking apertures 123, 132. Once the locking pin 1441 is not locked by the locking apertures 123, 132, the compression force exerted on the second spring 162 in the plunger 161 is released gradually and damply. As a result, both the piston rod 164 and the bifurcation 166 move upward gradually and damply (i.e., the buffer device 16 moves upward gradually). Hence, the locking mechanism 140 moves upward gradually and damply because the locking mechanism 140 is coupled to the buffer device 16. Also, the sliding tube 12 moves upward gradually and damply because the sliding tube 12 is coupled to the locking mechanism 140. As an end, the handle grip of the retractable luggage handle of the invention is capable of gradually and damply extending from the top of the luggage case a predetermined distance when the push button is pressed, as shown in FIGS. 4 and 6. At this position, a user can easily pull the handle grip 10 up to its maximum. In view of the above, the handle of the present invention is much safer as compared with the well known bouncing out handle.

Note that size of the opening of the vent hole 1610 formed on the top of the buffer device 16 is related to an extending speed of the handle, i.e., the wider the opening of the vent hole 1610 the faster the extending speed of the handle grip. Further, an airtight-ness of the sealing ring 163 on the body 1611 of the plunger 161 plays an important role in controlling the extending speed of the handle grip. Thus, the vent hole 1610 can be eliminated if the gradually and damply extending speed of the handle is not emphasized.

It is to be noted that the other side of the handle assembly is not described herein since it is a mirror image of one side thereof.

While the invention herein disclosed has been described by means of specific embodiments, numerous modifications and variations could be made thereto by those skilled in the art without departing from the scope and spirit of the invention set forth in the claims.

What is claimed is:

1. A retractable handle assembly for a luggage, the handle assembly including a pair of elonaste substantially parallel handle units and a handle grip interconnected the handle units, the handle grip having a push button, either of the handle units comprising:

a sliding tube connected to one end of the handle grip;

a support tube fixed at a bottom of the luggage, the sliding tube being slidably disposed in the support tube;

a locking device in a lower portion of the sliding tube;

a connecting rod interconnecting the push button and the locking device; and a buffer device within a lower portion of the sliding tube;

wherein the handle and is gradually and damply extendible from a top of the luggage a predetermined distance by pressing the push button in a pulling operation of the handle assembly, wherein the buffer device comprises an upper plunger, a spring anchored in the plunger, a piston rod inserted in the spring, a sealing ring anchored on a top of the piston rod, a lower n-shaped bifurcation urged against a bottom of the spring, and a pin hingedly coupled a top of the n-shaped bifurcation and a bottom of the piston rod together.

2. The retractable handle assembly of claim 1, wherein the plunger comprises an upper body, a vent hole on a top of the upper body, a pair of lower arms, and a hole at a lower portion of either arm.

3. The retractable handle assembly of claim 1, wherein the piston rod comprises an upper neck, an intermediate body, and a bottom tunnel.

4. The retractable handle assembly of claim 1, wherein the n-shaped bifurcation comprises two legs and two spaced top cylindrical members each having a tunnel.

5. A retractable handle assembly for a luggage, the handle assembly including an elongate handle unit and a handle grip on a top of the handle unit, the handle grip having a push button, the handle unit comprising:

a sliding tube connected to the handle grip;

a support tube fixed at a bottom of the luggage, the sliding tube being slidably disposed in the support tube;

a locking device in a lower portion of the sliding tube;

a connecting rod interconnecting the push button and the locking device; and a buffer device within a lower portion of the sliding tube;

wherein the handle grip is gradually and damply extendible from a top of the luggage a predetermined distance by pressing the push button in a pulling operation of the handle assembly, wherein the buffer device comprises an upper plunger, a spring anchored in the plunger, a piston rod inserted in the spring, a sealing ring anchored on a top of the piston rod, a lower n-shaped bifurcation urged against a bottom of the spring, and a pin hingedly coupled a top of the n-shaped bifurcation and a bottom of the piston rod together.

6. The retractable handle assembly of claim 5, wherein the plunger comprises an upper body, a vent hole on a top of the upper body, a pair of lower arms, and a hole at a lower portion of either arm.

7. The retractable handle assembly of claim 5, wherein the piston rod comprises an upper neck, an intermediate body, and a bottom tunnel.

8. The retractable handle assembly of claim 5, wherein the n-shaped bifurcation comprises two legs and two spaced top cylindrical members each having a tunnel.

9. The retractable handle assembly of claim 5, wherein the sliding tube comprises two upper holes for permitting a fastener to insert through to secure to the luggage, two intermediate locking apertures, and two opposite lower holes.

10. The retractable handle assembly of claim 5, wherein the support tube comprises an upper locking aperture, an intermediate locking aperture, and a lower hole.

* * * * *